United States Patent [19]

Sassak

[11] 3,958,440

[45] May 25, 1976

[54] UNIVERSAL TUBE BENDING MACHINE

[76] Inventor: Frank Sassak, 40979 Iriwn Drive, Mount Clemens, Mich. 48043

[22] Filed: Dec. 9, 1974

[21] Appl. No.: 530,699

[52] U.S. Cl. ..... 72/307; 72/218; 72/321

[51] Int. Cl.[2] ..... B21D 7/024

[58] Field of Search ..... 72/316, 321, 322, 320, 72/369, 386, 387, 318, 217, 218, 306, 307

[56] References Cited

UNITED STATES PATENTS

| | | | |
|---|---|---|---|
| 632,635 | 9/1899 | Bragger | 72/321 |
| 1,462,673 | 7/1923 | Wheeler | 72/321 |
| 2,452,050 | 10/1948 | Hayward | 72/321 |
| 3,505,852 | 4/1970 | Sassak | 72/321 |
| 3,662,575 | 5/1972 | Zmuda | 72/21 |

*Primary Examiner*—Lowell A. Larson
*Attorney, Agent, or Firm*—Cullen, Settle, Sloman & Cantor

[57] ABSTRACT

A universal tube bending machine includes a frame mounting an upper die clamp with a downturned channel. A support arm is pivoted to the frame and mounts a corresponding lower die clamp with an upturned tube receiving channel to grip the tube to be bent. A lower bending die is secured upon said arm outwardly of the lower die clamp, having an arcuate channel to receive the tube and of a predetermine radius corresponding to the desired bending radius for said tube. A power reciprocated bending arm including a depending die block is rotatably mounted on the frame on a center corresponding to the lower bending die, and has a downwardly opening tube engaging channel. The bending die block is adapted to rotate in the range of 1° to 180° making a corresponding bend in the tube. A power cylinder and rod on the frame operatively holds the arm, the lower die clamp and the lower bending die in registry with the tube during bending and thereafter is adapted to retract the lower die clamp and bending die. The bending die block is adapted to retract to inoperative position. A spindle axially engages the tube for successively and alternately advancing and rotating the tube angularly.

14 Claims, 6 Drawing Figures

UNIVERSAL TUBE BENDING MACHINE

BACKGROUND OF THE INVENTION

Heretofore there has been a need for a practical bending device for providing a series of bends in a single tube along the length thereof, of a predetermined arc and at a predetermined angle with respect to a prior bend. In industry tubes are required which have multiple bends in them at different angles and with different radius of bend. There has long existed the need of a universal tube bending machine which will automatically accomplish progressively a plurality of bends at a plurality of angles in a plurality of tubes simultaneously. Tube bending dies have been known which will anchor and bend the tube. However, there have been no practical machines devised which will in an automatic manner accept a plurality of tubes, feed them through a bending device which will produce simultaneously in each tube a bend of a predetermined arc and will thereafter advance the tube and orient the tube to the desired angle for an additional bend of the same or a different predetermined arc followed by additional successive feeding and orientation for as many bends as are desired.

BRIEF DESCRIPTION OF THE INVENTION

It is an object of the present invention to provide such a universal tube bending machine by which one or more tubes may be fed into and between lower and upper bending dies with means to automatically grip the tube followed by a bending operation, and providing a means for releasing the lower bending die and the lower die clamp from the tube and for successively feeding the tubes forwardly and rotating them for succeeding bending.

It is another object to provide an improved drive mechanism by which movement of a power reciprocated rack gear operating through a pinion rotates a drive shaft which through a series of sprockets and chains rotates a rock shaft to which is connected a bending arm with bending dies for a power bending operation.

It is another object to provide for a return of the bending dies together with a release of the lower bending dies and clamps from the tubes followed by an axial feeding of the tubes to the next bending point and an angular rotation of the tubes to the desired angle for a succeeding bend followed by a reclamping of the tubes.

These and other objects will be seen from the following specification and claims in conjunction with the appended drawings in which:

THE DRAWINGS

It will be understood that the above drawings illustrate merely a preferred embodiment of the invention, and that other embodiments are contemplated within the scope of the claims hereafter set forth.

DETAILED DESCRIPTION OF THE INVENTION

Figure 1:
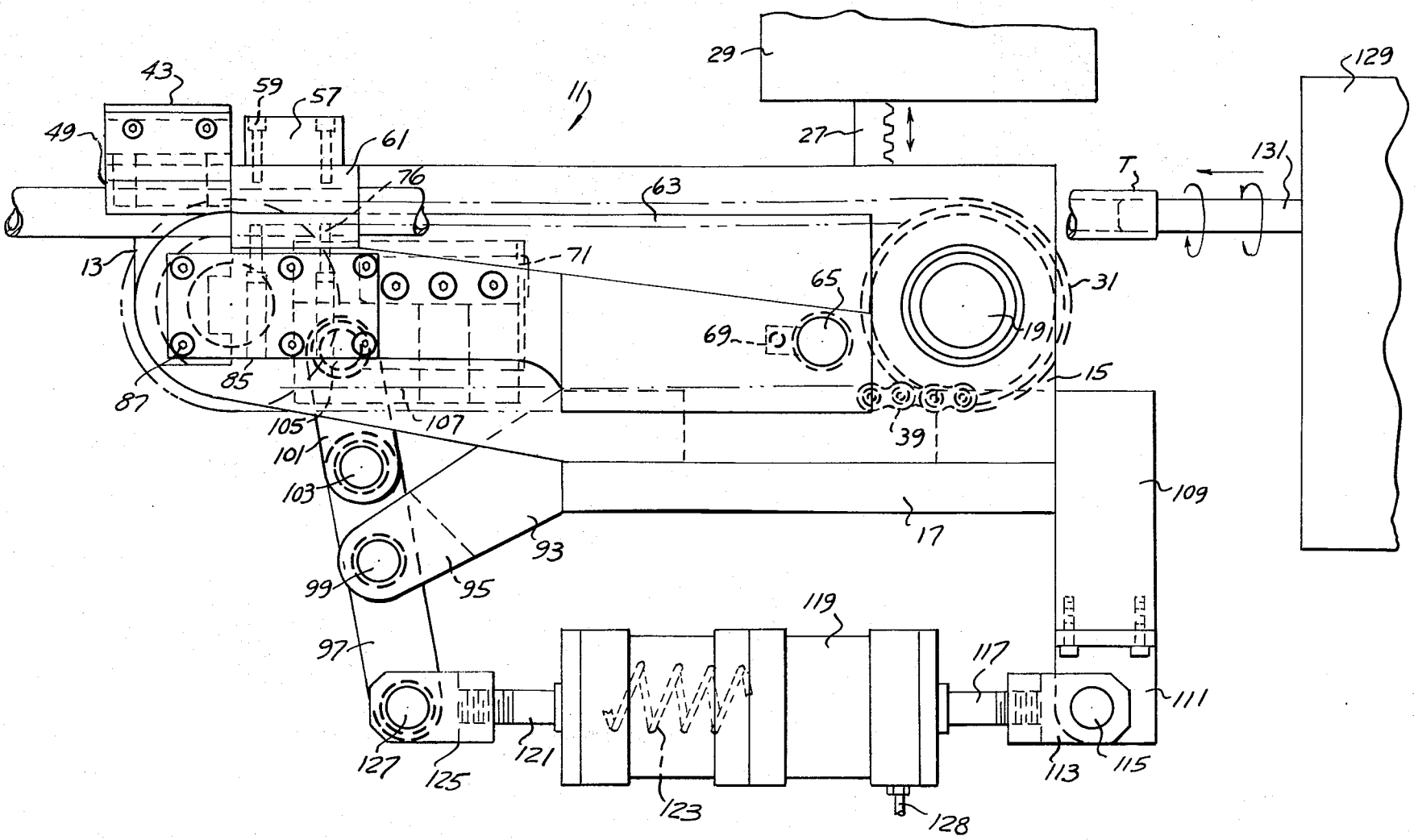
FIG. 1 is a fragmentary side elevational view of the present universal tube bending machine.
Figure 3:
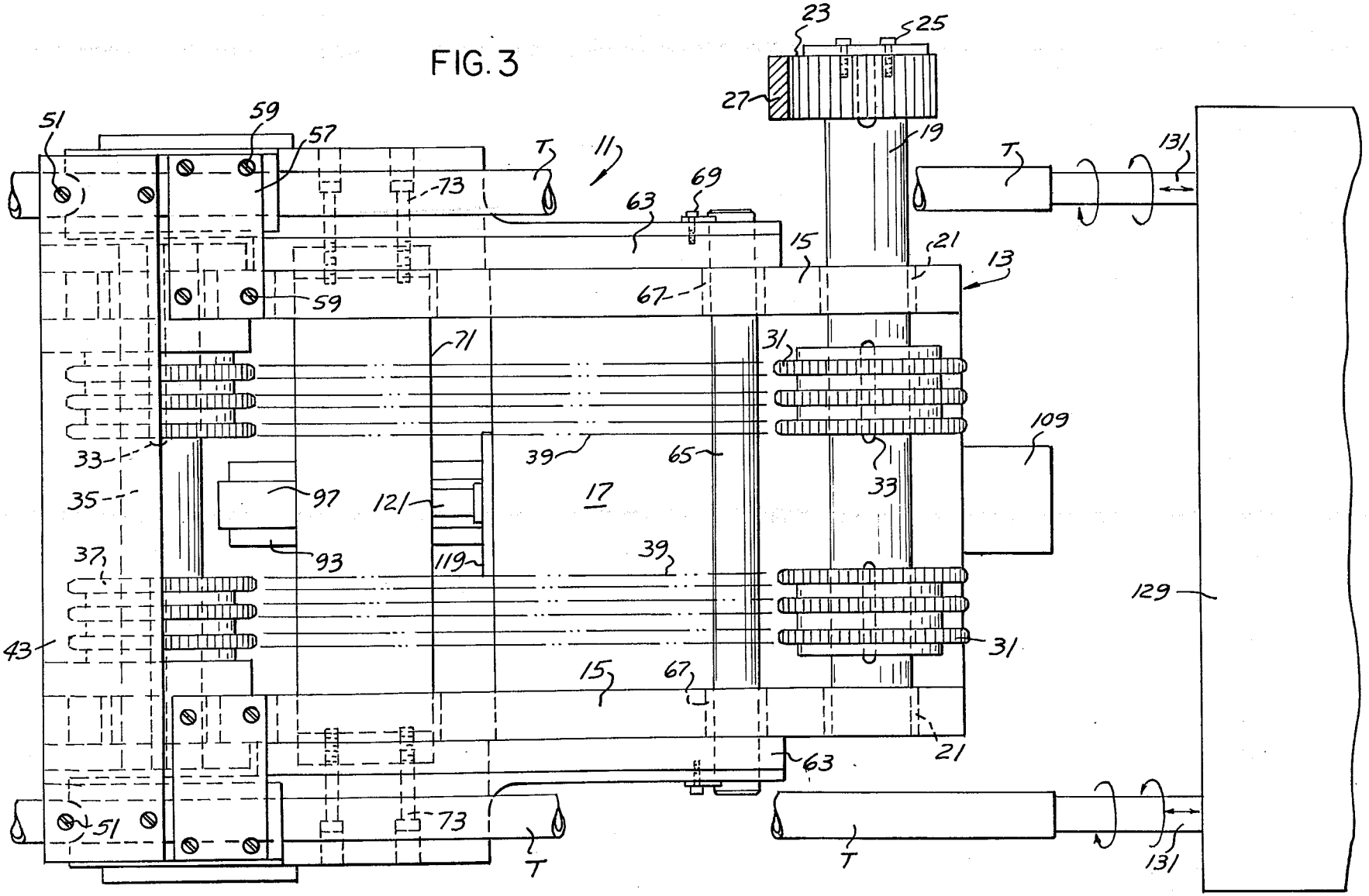
FIG. 3 is a plain view thereof.

The present universal tube bending machine 11, FIGS. 1 and 3 includes a die frame 13 having opposed upright parallel side plates 15 and the transverse bottom plate 17.

The rotatable drive shaft 19 is journaled through bearings 21 in said side plates and mounts pinion 23 at one end anchored thereto at 25. The reciprocal rack gear 27 is in mesh with said pinion and depends from the rack guide and support 29. Said rack guide and support includes power means for effecting reciprocal movements of rack gear 27 such as a motor operated pinion, for illustration. A series of laterally spaced sprocket gears 31 are mounted upon shaft 19 and keyed thereto at 33. Rock shaft 35 is parallel to and spaced forwardly of drive shaft 19 and is journaled through suitable bearings in the frame side plates 15.

Corresponding laterally spaced sprockets 37 are mounted upon rock shaft 35 and keyed thereto at 33. A series of sprocket chains 39 interconnect the respective aligned sprockets by which the shafts 19 and 35 rotate in unison under the control of gear rack 27.

Figure 2:
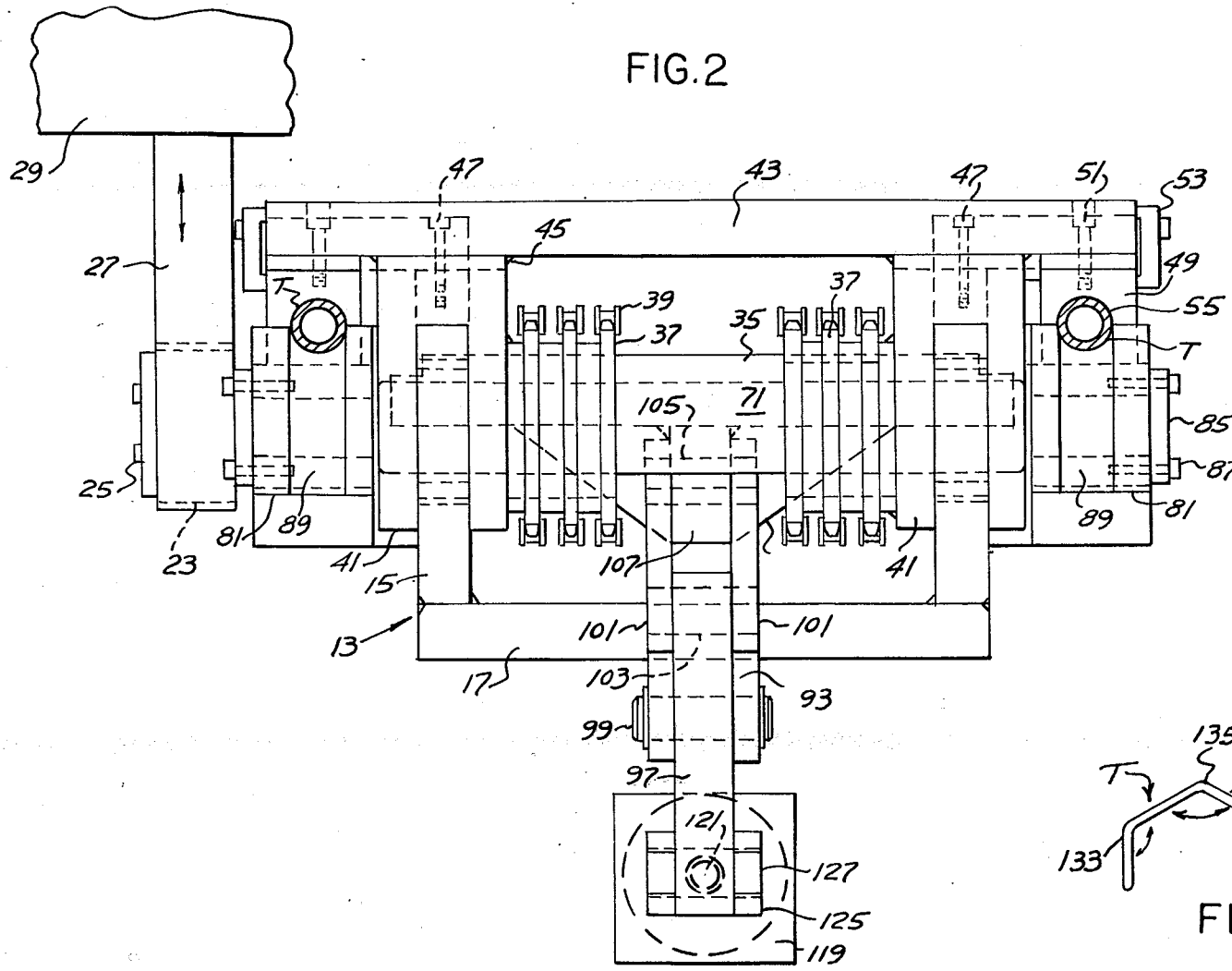
FIG. 2 is a left end elevational view thereof.

Referring to FIG. 2 a pair of spaced rock arms 41 of U-shape are mounted upon and keyed to shaft 35 and project radially therefrom. Elongated bending arm 43 extends transversely of the frame side plates and is secured to free ends of the rock arms as by the welds 45 and fasteners 47.

Said bending arm extends laterally outward of said rock arms and mounted at their ends upon the under surface thereof are a pair of bending die blocks 49. These are secured by fasteners 51 and clamps 53. Each bending die block has a downturned elongated channel 55 adapted for operative registry with the forwardly extending tubes T for bending the same with respect to the stationary bending dies 81.

Since the successive bends are usually over different arcs as to angle of bend, the head 29 has a programmed control so that the successive downward movements of rack 27 are of different distances. Thus, the extent of each bend corresponds to this downward movement.

As shown in FIGS. 1 and 3 the outwardly directed plates 57 are anchored to the frame side plates 15 by fasteners 59. Plates 57 outwardly of the side plates 15 have secured to their under surface the downwardly depending upper die clamps 61 also secured thereto by fasteners 59. Said upper die clamps have in their under surfaces the downwardly opening channels 62 which are arcuate in cross-section adapted to cooperatively receive upper portions of the tube T to be bent.

Arms 63 are arranged upon the exterior of the frame side plates 15 and are secured by key 69 to the pivot shaft 65. Said shaft extends through said arms and through corresponding bearings 67 in side plates 15 providing a pivot mounting for arms 63.

Transverse spacer 71 interconnects the forward free end portions of arms 63 and is secured thereto by a series of fasteners 73. Said arms are shown in further detail in FIGS. 4 and 5.

Lower die clamps 75 are mounted upon the forward end of arms 63 and are secured thereto by fasteners 76 FIG. 1. The lower die clamps have upwardly opening elongated channels 77 FIG. 4 which are arcuate in cross-section, adapted to cooperatively and snugly receive the lower portion of tube T. In the position of arm 63 shown in FIG. 4 the lower die clamp 75 is in cooperative registry with the upper die clamp 61 to grip the tube therebetween for a subsequent bending operation. Bending is shown completed in FIG. 4.

Tongue 79 is formed upon the forward end of the respective arms 63 and is adapted for snug interlock within a corresponding recess 83 in the respective bending die 81. Said die is secured thereto by the connector plate 85 with fasteners 87, FIG. 1.

Figure 4:
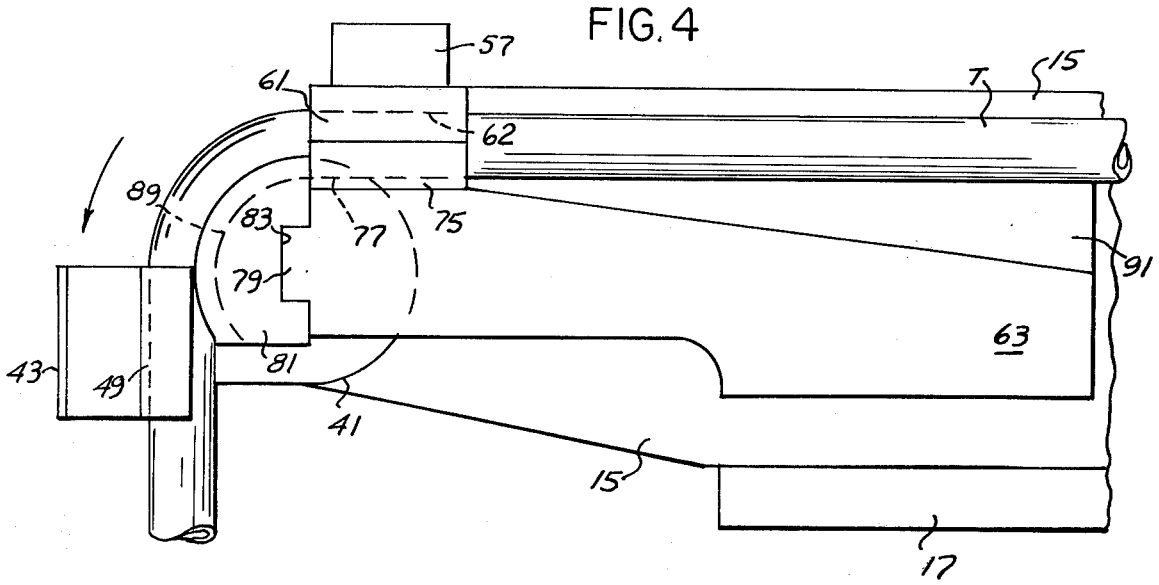
FIG. 4 is a fragmentary side elevational view of a portion of the frame with the tube clamps in registry and with the upper bending die shown at completion of the bending stroke.
Figure 5:
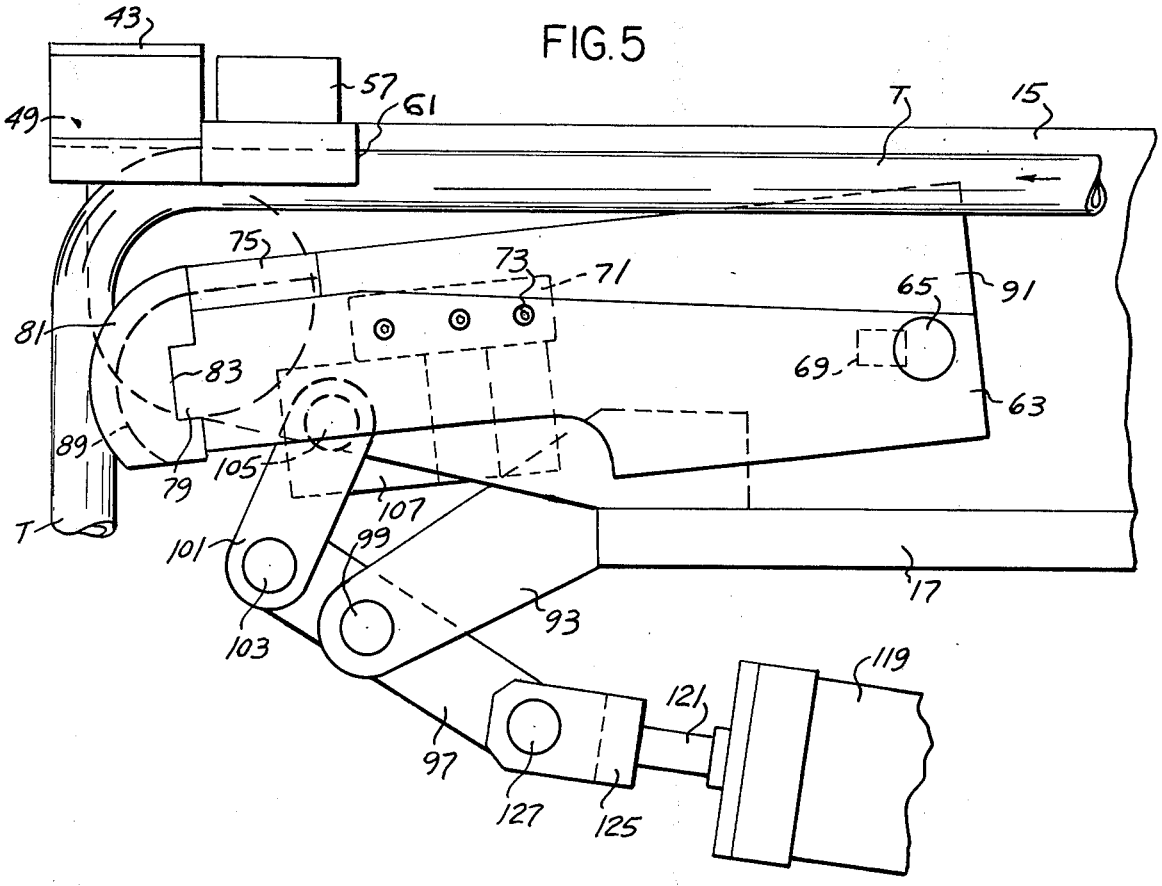
FIG. 5 is a similar view with the lower die clamp and lower bending die retracted and with the upper bending die retracted to permit longitudinal advance and orientation of the tube.

The lower bending die 81 has an outwardly opening channel 89 which is arcuate in cross-section corresponding to the diameter of the tube T to be bent. Said channel has a radius corresponding to the desired radius for a particular bending operation. Thus the lower bending die may be replaced by a corresponding bending die having a different radius as is desired. As shown in FIGS. 4 and 5 the sides of the respective arms 63 at their upper ends are recessed or cut away at 91 to provide a clearance for tubes T as they are projected into the upper and lower bending die clamps and past the bending die when in the position shown in FIG. 5.

As shown in FIGS. 1, 2, 3 and 5, the downwardly inclined pivot block 93 bifurcated at its outer end at 95, is secured to and depends from a forward end portion of bottom plate 17 of the frame. Control arm 97 is pivotally mounted upon block 93 by pin 99. The link 101 at the one end is pivotally connected by pin 103 to the upper end of arm 97. The opposite end of link 101 is pivotally connected by pin 105 to the tongue 107 secured to and depending from tilt arm spacer plate 71,

Bracket arm 109 FIG. 1 is centrally mounted upon the frame bottom plate 17 FIG. 3, mounts the depending pivot plate 111 which is connected by pivot pin 115 to clevis 113. Said clevis is connected by the shaft 117 to power cylinder 119 which contains the usual reciprocal piston and piston rod 121. The piston on said rod is normally biased to a retracted position by the coil spring 123 shown in phantom. Piston rod 121 projects outwardly of the hydraulic or pneumatic cylinder 119 and is connected to clevis 125, which in turn is pivotally connected by the pin 127 to one end of control arm 97, FIGS. 1 and 5.

In one embodiment of the invention with pressure fluid applied to the fitting 128, FIG. 1 the piston and connected piston rod 121 will be advanced against the action of the spring 123 moving the linkage so as to tilt the lower clamp support arms 63 to the tube securing position shown in FIGS. 1 and 4.

As shown in FIGS. 1 and 2 a head 129 is fragmentarily shown which has a power means adapted to effect selected longitudinal feed of the power driven rotatable spindles 131 and to provide for alternate rotary adjustments of said spindles. The outer end of the respective spindle 131 projects snugly into the free end of the tubes to be bent. Accordingly the tubes may be assembled into the bending machine for a first bending operation with the free ends of each spindle frictioningly projecting into said tubes. The tubes may be of such length that they will normally extend past the upper and lower die clamps 61 and 75 and past the upper bending die 49 to the extent desired. Alternately the spindles 131 could be set so that once the tube to be bent has been assembled with respect to the spindle, said spindle will initially advance it longitudinally to the correct position. The specific construction of the head with tube advancing and orienting spindles is conventional. Since the bends in the tube are at different longitudinal distances, the longitudinal feed for the spindle 131 is programmed and automatic for each of any number of consecutive bends up to ten or more. Also since the bends are at different angles to each other, the controls for rotary movement of the spindle in either direction are programed for automatic positioning for each successive bend.

OPERATION

The sequence of operation is as follows. Once the tubes have been connected to the spindles 131, and with respect to the upper and lower die clamps 61 and 75, and forwardly of the retracted bending die blocks 49, the cylinder 119 is actuated by the application of pressure fluid to fitting 128. This causes forward movement of piston rod 121 to the position shown in FIG. 1 from the position shown in FIG. 5. This secures the tubes with respect to the upper and lower die clamps 61 and 75. At that time there is a downward movement of rack gear 27 causing rotary movement of drive shaft 19 a predetermined distance. Through the sprockets and chains shown, FIGS. 1, 2 and 3, there will be a corresponding rotary movement of rock shaft 35 to which is connected the transverse bending arm 43. Said bending arm mounts at its outer ends the upper bending die blocks 49 which operatively engage the respective tubes bending the same to the position shown in FIG. 4, or any intermediate position. This depends on the extent of programed downward movement of rack gear 27 for each successive bend.

Figure 6:
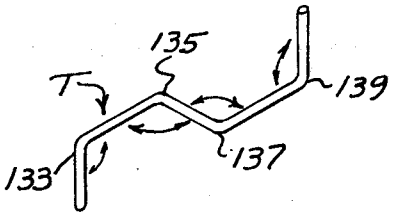
FIG. 6 is a fragmentary perspective view of a tube with a series of angularly related bends formed therein by the present tube bending machine.

Thereafter, the arms 63 are retracted or pivoted downwardly to the position shown in FIG. 5. This occurs by releasing the pressure fluid from fitting 128 and permitting the spring 123 to retract the piston and piston rod 121. The arms 63 tilt angularly downwardly to the release position shown to disengage the tubes from the die clamps. Thereafter, or simultaneously therewith the rack gear 27 moves upwardly, causing the shafts 19 and 35 to rotate in the opposite direction. This returns the upper bending die blocks 49 from the position shown in FIG. 4 to the inactive position of FIG. 5 ready for the next bending operation. With the tubes now released, the spindles 131 are effective to longitudinally advance the respective tubes a predetermined distance. At the same time or successively the spindles 131 will rotate the tubes the desired angle in the same or opposite directions for determining the angular positioning of the second bend 135 such as shown in FIG. 6. The first bend is shown at 133.

The process is repeated with successive opening and closing of the die support arms 63 and the corresponding clamps. The intermittent varied movements of rack gear 27 rotate the bending dies and return the same to inoperative position. Thus, automatically there are provided in the two tubes T, and simultaneously, a series of identical or opposite bends along their lengths at preselected distances, at preselected arcs for each bend, and at preselected angular relation to each other.

In this manner, a series of bends are formed in a pair of tubes in the present embodiment. These tubes are longitudinally fed by spindles 131 by a conventional power means known in the art, and at the same time, are oriented or rotated as designated by arrows, FIG. 3, to the desired angle.

The spindles 131 may be arranged so that they may rotate in the same or opposite directions to provide a symmetrical pair of bent tubes or the tubes may be identical in shape.

Rather than employ spring 123 for returning the piston and piston rod 121 to inoperative position for lowering the arms 63, there may be an additional fitting at the opposite end of cylinder 121 for the application of pressure fluid.

The final work product shown in FIG. 6 may consist of a series of progressive bends at 133, 135, 137 and 139.

I claim:

1. In a universal tube bending machine, an elongated frame including parallel spaced side plates and a bottom plate;

an upper die clamp spaced laterally outward of a side plate, secured thereto and including an elongated downturned channel of semi-circular cross section adapted to receive the upper part of a tube to be bent;

an elongated support arm upon the outside of said side plate, at one end pivotally mounted thereon;

a lower die clamp overlying the other end of said arm secured thereto and including an elongated upturned channel of semi-circular cross section adapted to receive the lower part of a tube to be bent, for gripping said tube relative to the upper die clamp during bending and adapted to tilt downwardly after bending to release the tube;

a lower bending die secured upon said arm outwardly of and adjacent said lower die clamp, and having an arcuate channel to receive the tube, and of a radius corresponding to the radius of bend desired;

a power reciprocated bending arm including a bending arm block rotatably mounted on and transversely of said frame on a center corresponding to said lower bending die, and having an elongated undercut channel of semi-circular cross section for operative registry with said tube;

said bending die block being initially in registry with said die clamps and rotatable through an arc in the range of 1° to 180° approximately.

2. In the bending machine of claim 1, said bending arm being reractable; a power means on said frame and secured to said support arm for clamping the tube during bending and retracting therefrom tilting the arm and releasing said tube;

said tube adapted to be advanced a predetermined distance, and rotated through a predetermined angle for a further bending operation;

3. In the bending machine of claim 2, said power means including a cylinder at one end pivotally mounted on the frame and a reciprocal piston rod projecting therefrom;

and a pivot linkage on said frame interconnecting said piston rod and support arm.

4. In the bending machine of claim 2 a power head including a power rotated spindle adapted to snugly project axially into one end of said tube;

said spindle adapted to axially advance the tube through said die clamps past said bending die a predetermined distance for each bend;

said spindle adapted to successively rotate the tube through a predetermined angle;

said spindle adapted for succeeding alternate advances and rotations whereby a plurality of variably spaced successive bends are formed in the tube at different angles respectively.

5. In the tube bending machine of claim 2, said power means including a pivot block on said frame bottom plate;

a control arm intermediate its ends pivoted on said block;

a cylinder at one end pivotally mounted on the frame, a reciprocal piston rod projecting from the cylinder, at one end pivoted to one end of said control arm, and a link pivotally interconnecting the other end of said control arm and said clamp support arm.

6. In the bending machine of claim 1, a power head including a power rotated spindle adapted to snugly project axially into one end of said tube;

said spindle adapted to axially advance the tube through said die clamps past said bending die a predetermined distance;

said spindle adapted to successively rotate the tube through a predetermined arc;

said spindle adapted for successive, alternate advances and rotations whereby a plurality of spaced successive bends are formed in the tube at different angles respectively.

7. In the bending machine of claim 1, the mounting of said bending arm including a rock shaft spanning and journaled upon said side plates;

a rock arm extending radially of and secured to said shaft and at a free end secured to said bending arm.

8. In the bending machine of claim 7, a rockable drive shaft parallel to and spaced rearwardly of said rock shaft and journaled upon said side plates;

a pinion secured on said drive shaft;

a head overlying said frame and including an intermittently reciprocal rack gear in mesh with said pinion for effecting intermittent reciprocal movements of said drive shaft;

and sprocket gear and chain means interconnecting said shafts for rotation in unison.

9. In the bending machine of claim 7, the head for the reciprocal rack gear being programed for determining the extent of downward movement of the rack gear, and corresponding bending arc, for each successive bend.

10. In a universal tube bending machine, an elongated frame including parallel spaced side plates and a bottom plate;

an upper die clamp spaced laterally outward of each side plate and secured thereto, each clamp including an elongated downturned channel of semicircular cross section adapted to receive the upper part of a tube to be bent;

elongated support arms upon the outside of said side plates, at their one ends pivotally mounted thereon;

a cross bar having a depending tongue interconnecting their other ends;

a lower die clamp overlying the other end of each support arm and including an elongated upturned channel of semicircular cross section adapted to receive the lower part of a tube to be bent, for gripping said tube relative to the corresponding upper die clamp during bending and adapted to tilt downwardly after bending to release the tube;

a lower bending die secured upon each arm outwardly of and adjacent said lower die clamp and having an arcuate channel to receive the tube, of a radius corresponding to the radius of bend desired;

a power reciprocated bending arm overlying and extending transversely of said side plates and clamp support arms, and rotatably mounted on said frame on a center corresponding to said lower bending dies;

bending die blocks depending from the outer ends of said bending arm overlying and in registry with said lower bending dies respectively;

each bending die block having an elongated undercut channel of semicircular cross section for operative registry with said tubes;

said bending dies being initially in registry with said upper die clamps and selectively for each bend rotatable through an arc in the range of 1° to 180°, bending said tubes simultaneously;

a power cylinder at one end pivotally mounted upon the under side of said frame, and including a reciprocal piston rod projecting therefrom;

and a linkage pivoted on said frame bottom plate interconnecting said piston rod and said arm cross bar tongue, for holding said arms and lower die clamps in snug operative registry with said upper die clamps and the tubes to be bent, said piston rod on retraction adapted to lower said lower clamp support arms disengaging said tubes.

11. In the bending machine of claim 10, a power head including a pair of laterally spaced power rotated spindles adapted to snugly project axially into one end of longitudinally disposed tubes extending between the respectived upper and lower die clamps, said spindles adapted to axially advance the respective tubes past said die clamps and said bending dies a predetermined distance;

said spindles adapted to successively rotate the tubes through a predetermined arc and successively advance the tubes to a second bending location;

said spindles adapted for succeeding variable alternate advances and rotations whereby a plurality of successive bends are formed in each of the tubes at different angles respectively.

12. In the bending machine of claim 11, the mounting of said bending arm including a rock shaft spanning and journaled upon said side plates;

spaced radial rock arms secured to said shaft at the ends thereof with the free ends of said rock arms secured to said bending arm;

a rockable drive shaft parallel to and spaced rearwardly of said rock shaft and journaled upon said side plates;

a pinion secured to said drive shaft;

a head overlying said frame and including an intermittently and variably reciprocal rack gear in mesh with said pinion for effecting intermittent variable reciprocal movements of said rock shaft;

and sprocket gear and chain means interconnecting said shafts for rotation in unison.

13. In the tube bending machine of claim 12, power raising of said arms and lower die clamps gripping the tubes relative to the upper die clamps;

successive downward movement of said rack gear rotating said shafts and bending arm with attached bending die blocks for simultaneously bending said pair of tubes;

successive upward movement of said rack gear returning the bending dies to inoperative position;

said piston rod retracting to withdraw the lower die clamps from the tubes;

said spindles successively advancing both tubes to second bending points and simultaneously rotating said tubes for the desired bending angle relative to the first bends.

14. In the bending machine of claim 11, the power head for for said spindles being programed for determining the extent of longitudinal feed, and the extent of angular rotation of said spindles for each successive bend.

* * * * *